United States Patent [19]

Kitto, Jr. et al.

[11] 4,264,041

[45] Apr. 28, 1981

[54] LOW PRESSURE DROP PULVERIZER THROAT

[75] Inventors: John B. Kitto, Jr., Alliance; Edwin Kowalski, Akron, both of Ohio

[73] Assignee: The Babcock & Wilcox Co., New Orleans, La.

[21] Appl. No.: 79,775

[22] Filed: Sep. 28, 1979

[51] Int. Cl.[3] ..... B02C 15/06

[52] U.S. Cl. ..... 241/57; 241/103; 241/119; 241/121

[58] Field of Search ..... 241/57, 58, 60, 115–122, 241/103, 107, 109

[56] References Cited

U.S. PATENT DOCUMENTS

| | | | |
|---|---|---|---|
| 2,378,681 | 6/1945 | Bailey et al. | 241/103 X |
| 2,545,254 | 3/1951 | Bice | 241/103 X |

*Primary Examiner*—Mark Rosenbaum

*Attorney, Agent, or Firm*—Robert J. Edwards; Robert C. Mai

[57] ABSTRACT

A new and improved design of a pulverizer air throat for low-pressure drop, reduced erosion and improved flow distribution.

3 Claims, 3 Drawing Figures

22
3
R3
D1
34
32
36
44
R2
3
R1

42
42
36
L1
D2
30°
38
40
44

LOW PRESSURE DROP PULVERIZER THROAT

TECHNICAL FIELD

The present invention relates to an improved air throat design in pulverizers of the type in which solid materials are comminuted by the relative motion of grinding elements in mutual contact and wherein the pulverized material is air-conveyed from the grinding elements to the outlet of the pulverizer.

BACKGROUND ART

Pertinent existing art relating to pulverizer throat designs are Schwartz, U.S. Pat. No. 2,275,595; Bailey et al, U.S. Pat. No. 2,378,681; Ebersole, U.S. Pat. No. 2,473,514; and Bice, U.S. Pat. No. 2,545,254, all of which are assigned to the Babcock & Wilcox Company, assignee of the present invention. Schwartz, '595, discloses curved annular passages forming a throat discharging scavenging air in the direction of the grinding elements. Bailey et al, '681, discloses a design for constant air velocity through the throat. Ebersole, '514, discloses an adjustable throat, and Bice, '254, discloses an eccentric throat design for air distribution. The prior art is indicative of a need to solve the problems associated with the pulverization and transport of solid materials at minimum capital, maintenance and operating costs involving air pressure losses, excessive dribble of solid material downward through the throat and erosion of surfaces in contact with the transport of solid material.

SUMMARY OF THE INVENTION

The present invention solves the current problems involved with the pulverization and transport of solid materials. For explanatory purposes, the invention will be described in relation to an air-swept coal pulverizer of the roll-and-race type using three large diameter grinding rolls to crush the coal although it is understood that the invention applies to any type of air-swept pulverizer for the grinding of solid material. A new throat has been designed and tested having increased radii of curvature at the inlet and outlet beyond standard engineering practice, and vanes, which divide the annular throat into a series of ports, are provided with airfoils on their top surfaces.

BEST MODE FOR CARRYING OUT THE INVENTION

Figure 1:
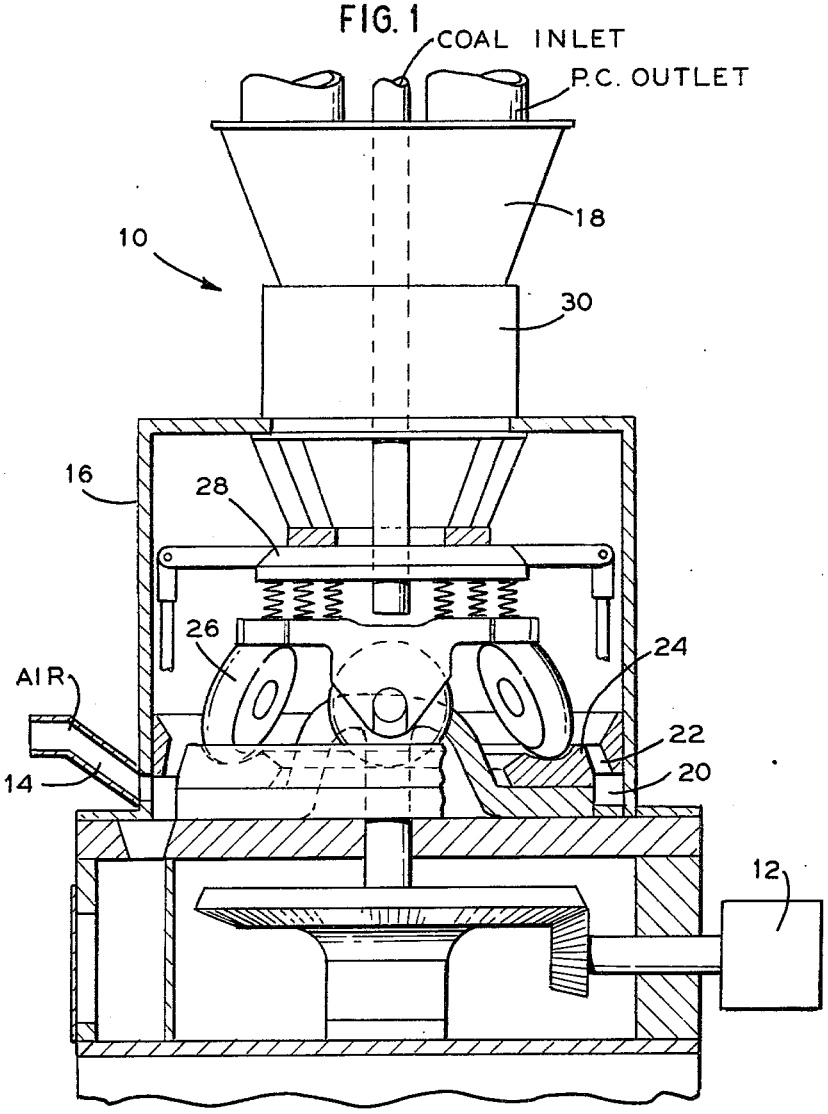
FIG. 1 is a sectional schematic view of an air-swept pulverizer embodying elements of the invention.

Referring to FIG. 1, the apparatus 10 is an air-swept pulverizer or mill of a known type utilizing a roll-and-ring grinding method for the comminution of solid fuel. The pulverizer drive 12 is connected by a series of gears and shafts to rotate the grinding ring 24 about a vertical central axis. Primary or carrier air radial inlet 14 communicates with an annular plenum 20 which in turn communicates with and supplies carrier air to pulverizer throat 22. The assembly is contained within a main housing 16 and pulverized coal and air exit the mill 10 through outlet 18, after passage through classifier 30, in a plurality of pipes to supply fuel and air to a combustion chamber, not shown. Large-diameter rolls 26 cooperate with the circular race of grinding ring 24 to grind the coal. The rolls 26 rotate in place and do not revolve about the central vertical axis of the mill, the grinding action being effected by the relative motion of the ring and rolls. A spring-loaded device 28 applies a downward force on the axles of rolls 26 thereby providing a compressive force between the rolls and ring for proper grinding action on the coal.

Figures 2, 3:
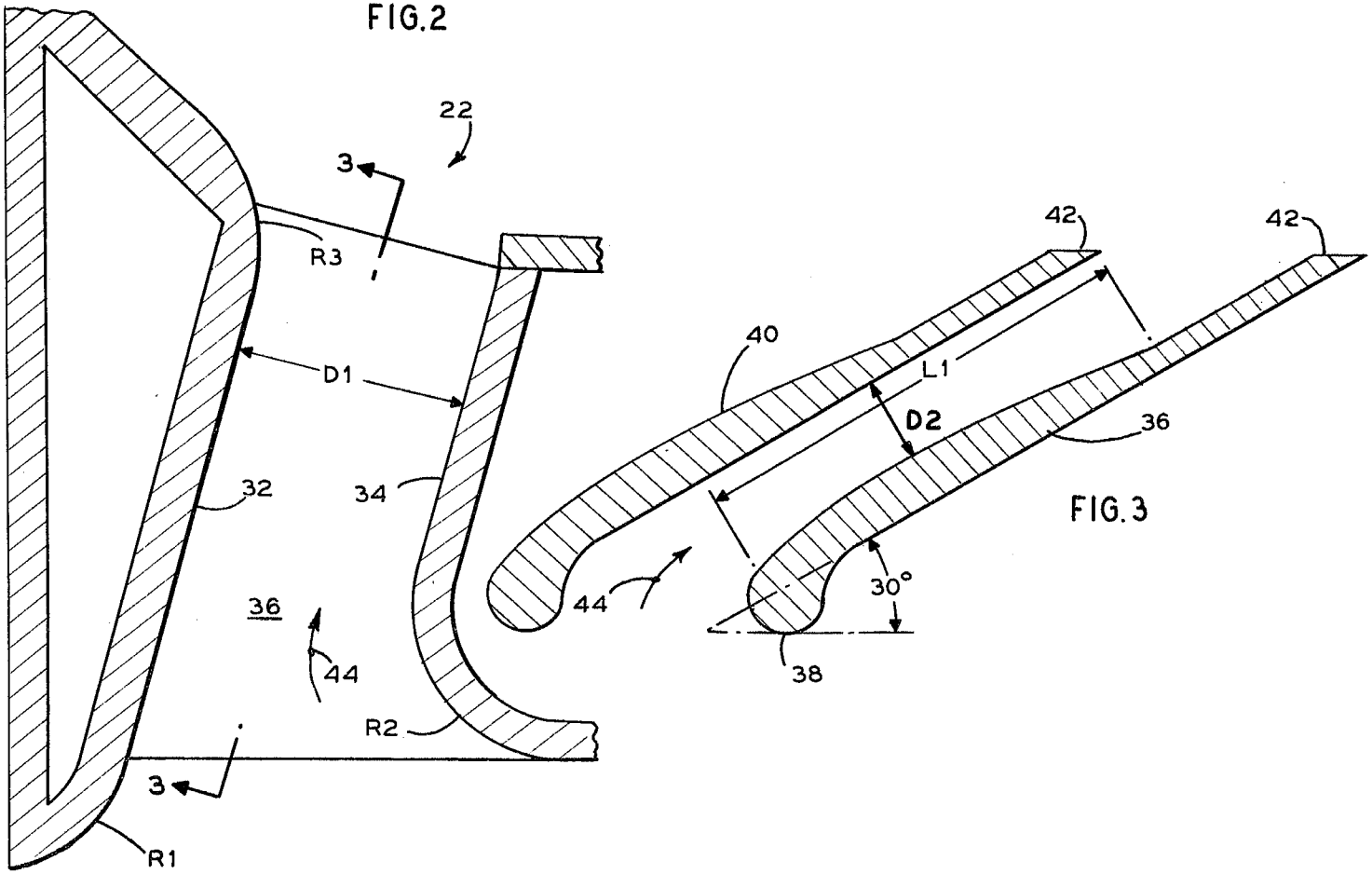
FIG. 2 is a sectional view of the pulverizer throat.
FIG. 3 is a sectional view of a pair of adjacent throat vanes taken along the line 3—3 of FIG. 2.

FIG. 2 is an enlarged section of the pulverizer throat 22 showing the large, extended radii of curvature R1 and R2 at the throat inlet and radius of curvature R3 at the throat outlet. Outside and inside throat walls 32 and 34 respectively and vanes 36 complete the configuration of the throat. It has been discovered after an extensive series of laboratory flow model tests that the optimum ratio of the radii of curvature R1, R2 and R3 to the radial width of throat D1 is greater than 0.5 and less than 1.5. Standard engineering practice would dictate a R/D ratio of 0.25. Arrow 44 indicates direction of air flow through the throat.

Referring to FIG. 3, two adjacent vanes are depicted. The circumferential length of the throat is divided by a plurality of vanes 36 extending from the throat inlet to the throat outlet and inclined at an angle to the horizontal, preferably 30 degrees. The vanes extend over the entire radial width of the throat and form a series of individual ports which discharge tangentially to the grinding ring. The vane 36 is designed with a tear-drop shape 38 in section at the leading end and having an airfoil shape 40 on a portion of the upper surface. The trailing end of the vane is of constant thickness and terminates with a bevel 42. Laboratory tests on two- and three-dimensional models show that the ratio of the airfoil length L1 to the minimum distance between vanes D2 is greater than 1.0 and less than 5.0.

The primary air inlet 14, FIG. 1, delivers air at one location radially into plenum 20, FIG. 1. Due to the design of the individual throat ports with parallel vanes around the complete circumference of the throat, the air flow in the plenum can approach the vanes in different directions. The curvature at the throat inlet extends the region of accelerating flow significantly into the throat producing a more uniform throat velocity distribution and eliminates the effect of throat inlet flow direction on flow characteristics. The airfoil configuration of the top surface of the vane cooperates with the throat inlet curvature in advancing and continuing the flow acceleration into the throat. In addition, the airfoil shape first produces a flow acceleration to the velocity necessary to prevent material dribble down through the throat and then a deceleration of the flow through the remaining portion of the throat to the outlet, decreasing the outlet shock loss in pressure.

The existing design of the throat of air-swept pulverizers of the type shown in FIG. 1 suffered from low-velocity regions, particularly at the throat exit where recirculation of fuel and air promoted dribble, flow separation, excessive entrance and exit shock losses and inlet flow maldistribution all of which resulted in high-air pressure drop. The present invention provides an improved velocity distribution within the throat and permits designing for minimum velocity to prevent dribble within the throat rather than the throat outlet resulting in a decreased air flow at full load on the mill. Test results indicate a reduction in pulverizer full load pressure drop of 1.5 inches of water due to throat geometry design changes. An additional pressure drop reduction of 3.0 inches of water results from a reduction in the minimum design average throat velocity to prevent dribble of coal made possible by the more uniform velocity distribution leaving the new throat design. The reduced throat velocity is physically achieved by increasing the minimum throat flow area in the new design while maintaining the same full load pulverizer air flow.

The embodiments of the invention in which an exclusive property or privilege is claimed are defined as follows:

1. In combination with a pulverizer for comminuting solid material which includes a casing having an outlet in its upper portion for pulverized material suspended in carrier air, inlets for carrier air and material to be pulverized, a grinding ring in a lower portion of the pulverizer, means for rotating the grinding ring about a central vertical axis, a multiplicity of grinding elements cooperating with the grinding ring for grinding the material deposited thereon, an annular carrier air plenum located below the grinding ring, radially spaced inside and outside walls defining a throat, a throat inlet, a throat outlet, and radial width of the throat communicating with the air plenum and discharging carrier air adjacent to the grinding ring, vanes mounted in the throat at equal angles to the horizontal and arranged to subdivide the throat into a plurality of circumferentially adjacent passages, wherein the improvement comprises an increased radius of curvature of the inside wall and outside wall of the throat inlet and an increased radius of curvature of the outside wall of the throat outlet beyond standard engineering practice such that the ratio of the radius of curvature of the inside and outside walls of the throat inlet and the outside wall of the throat outlet to the radial width of the throat is greater than 0.5 and less than 1.5 and vanes, each vane having a top side with an air foil configuration resulting in a gradual acceleration of air flow from the throat inlet to an intermediate portion of the throat and a gradual deceleration of air flow from the intermediate portion to the throat outlet to minimize dribble of solid material downward through the throat, to reduce erosion of bounding surfaces at the throat outlet and to reduce air pressure loss through the pulverizer.

2. The improved pulverizer of claim 1 in which the ratio of the length of the airfoil configuration on the top side of the vanes to the minimum distance between vanes is greater than 1.0 and less than 5.0.

3. The improved pulverizer of claim 1 in which the throat outlet of carrier air is tangential to the grinding ring.

* * * * *